US008966785B2

(12) United States Patent
Park et al.

(10) Patent No.: US 8,966,785 B2
(45) Date of Patent: Mar. 3, 2015

(54) METHOD FOR CONTROLLING A LAUNDRY TREATMENT APPARATUS ACCORDING TO TARGET RELATIVE HUMIDITY

(75) Inventors: Hye Yong Park, Changwon-si (KR); Yang Hwan Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 245 days.

(21) Appl. No.: 13/515,198

(22) PCT Filed: Dec. 13, 2010

(86) PCT No.: PCT/KR2010/008888

§ 371 (c)(1),
(2), (4) Date: Jun. 11, 2012

(87) PCT Pub. No.: WO2011/074840

PCT Pub. Date: Jun. 23, 2011

(65) Prior Publication Data

US 2012/0285037 A1 Nov. 15, 2012

(30) Foreign Application Priority Data

Dec. 15, 2009 (KR) ..... 10-2009-0124666

(51) Int. Cl.

| | |
|---|---|
| ***F26B 3/00*** | (2006.01) |
| ***D06F 58/10*** | (2006.01) |
| ***D06F 58/28*** | (2006.01) |

(52) U.S. Cl.

CPC ..... *D06F 58/10* (2013.01); *D06F 58/28* (2013.01); *D06F 2058/2819* (2013.01)

USPC ..... 34/474; 34/495; 34/524; 34/557

(58) Field of Classification Search

CPC ..... F26B 21/06; F26B 21/08; F26B 21/083; D06F 58/28; D06F 58/10; D06F 2058/2819; B01D 53/261

USPC ..... 34/474, 403, 495, 524, 557, 480, 472, 34/475

See application file for complete search history.

(56) References Cited

U.S. PATENT DOCUMENTS

| | | | | |
|---|---|---|---|---|
| 6,098,310 | A * | 8/2000 | Chen et al. | 34/475 |
| 6,141,887 | A * | 11/2000 | Chen et al. | 34/475 |
| 6,405,453 | B1 | 6/2002 | Salameh et al. | |
| 2005/0252028 | A1 | 11/2005 | Park et al. | |

FOREIGN PATENT DOCUMENTS

| | | | |
|---|---|---|---|
| CN | 1696390 | A | 11/2005 |
| CN | 1888290 | A | 1/2007 |
| CN | 1966841 | A | 5/2007 |
| EP | 1790769 | | 5/2007 |

(Continued)

*Primary Examiner* — Kenneth Rinehart
*Assistant Examiner* — Bao D Nguyen
(74) *Attorney, Agent, or Firm* — McKenna Long & Aldridge LLP

(57) ABSTRACT

A control method of a laundry treatment apparatus is disclosed. The control method of a laundry treatment apparatus includes a humidity measuring step of measuring a relative humidity of an accommodating space accommodating laundry, a target humidity setting step of setting a target relative humidity based on the relative humidity measured in the humidity measuring step, to dry the laundry, and a heated air supplying step of supplying heated air to the accommodating space based on the target relative humidity.

16 Claims, 8 Drawing Sheets

(56) References Cited

FOREIGN PATENT DOCUMENTS

| | | | |
|---|---|---|---|
| EP | 1790769 | A1 * | 5/2007 |
| GB | 2275992 | | 9/1994 |
| KR | 10-2005-0118484 | A | 12/2005 |
| KR | 10-0638221 | B1 | 10/2006 |

* cited by examiner

METHOD FOR CONTROLLING A LAUNDRY TREATMENT APPARATUS ACCORDING TO TARGET RELATIVE HUMIDITY

This application is a National Stage Entry of International Application No. PCT/KR2010/008888, filed Dec. 13, 2010, and claims the benefit of Korean Application No. 10-2009-0124666, filed on Dec. 15, 2009, each of which is hereby incorporated by reference for all purposes as if fully set forth herein.

TECHNICAL FIELD

The present invention relates to a control method of a laundry treatment apparatus.

BACKGROUND ART

Recently, various types of laundry treatment apparatuses have been used together with washing machines used to wash clothes, cloth items, beddings and the like. For example, drum type dryers used to dry washed laundry items, a cabinet type dryers used to dry laundry items hung therein and refreshers used to refresh laundry items supplied hot air.

However, such a cabinet type laundry treatment apparatus has several disadvantages.

DISCLOSURE

Technical Problem

To solve the problems, an object of the present invention is to provide a control method which is able to uniformly maintain the amount of moisture contained in each of laundry items, regardless of the amount of laundry items, when drying for the laundry items is completed.

Technical Solution

To achieve these objects and other advantages and in accordance with the purpose of the invention, as embodied and broadly described herein, a The control method of a laundry treatment apparatus includes a humidity measuring step of measuring a relative humidity of an accommodating space accommodating laundry, a target humidity setting step of setting a target relative humidity based on the relative humidity measured in the humidity measuring step, to dry the laundry, and a heated air supplying step of supplying heated air to the accommodating space based on the target relative humidity.

In another aspect of the present invention, a control method of a laundry treatment includes a target relative humidity setting step of setting a target relative humidity based on a selected course, to dry laundry; a target maximum humidity and a target minimum humidity setting step of setting a target maximum humidity and a target minimum humidity according to the selected course; and a heated air supplying step of supplying heated air based on at least one of the target relative humidity, the target maximum humidity and the target minimum humidity.

Advantageous Effects

The present invention has following advantageous effects. The control method including the above steps may detect the relative humidity in the initial stage of the drying, when setting the target relative humidity used to determine the completion of drying, and it may set the target relative humidity based on the measured relative humidity. As a result, it is possible to remove deviation of the amount of water remaining in the laundry after completing the drying, regardless of the laundry amount.

DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE

Reference will now be made in detail to the specific embodiments of the present invention, examples of which are illustrated in the accompanying drawings. Wherever possible, the same reference numbers will be used throughout the drawings to refer to the same or like parts.

As follows, a laundry treatment apparatus according to an exemplary embodiment of the present invention will be described in reference to the accompanying drawings.

Figure 1:
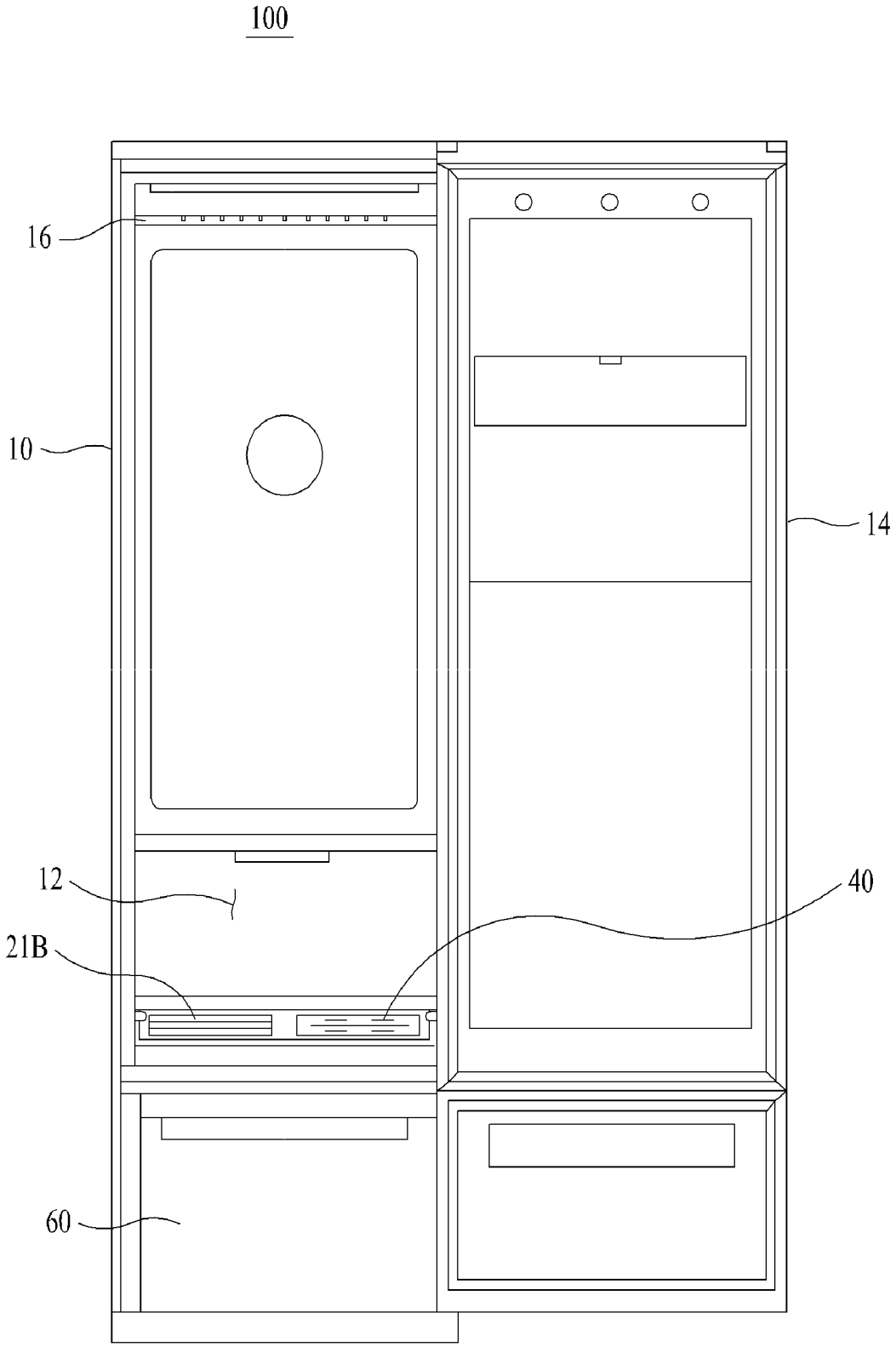
FIG. 1 is a front view illustrating a laundry treatment apparatus according to an exemplary embodiment of the present invention.

FIG. 1 is a front view illustrating that a door 14 provided in the laundry treatment apparatus according to the exemplary embodiment of the present invention is open.

This specification embodies a refresher configured to supply heated air to laundry to refresh, as laundry treatment apparatus, and the present invention is not limited thereto. A subject matter of the present invention may be applicable to other types of laundry treatment apparatuses including a heat pump, which will be described later. Here, the terminology 'refresh' means a process configured to supply air, heated air, water, mist and steam to laundry to performing wrinkles removal, deodorizing, sanitizing, static electricity prevention or warming. 'laundry' mentioned in the present specification includes not only clothes and apparel but also wearable items including shoes, socks, gloves, hats and mufflers people can wear, and usable laundry items including dolls, towels and beddings people can use. That is, the laundry may include all kinds of laundry items of which washing may be performed.

In reference to FIG. 1, a laundry treatment apparatus 100 according to the embodiment of the present invention includes a cabinet 10 having an accommodating space 12 formed therein to accommodate laundry, an air supply device (22, see FIG. 5) configured to supply air or heated air to the accommodating space 12, a moisture generating device (30, see FIG. 2) configured to spray water, moist or steam to the accommodating space 12 selectively, and a control part (not shown) configured to control the air supply device 22 and the moisture generating device 30.

A variety of components, which will be described later, are provided in the cabinet 10 and the accommodating space 12 to accommodate laundry therein is provided in the cabinet 10. The accommodating space 12 may be in communication with an outside by a door 14 selectively and a variety of supporters 16 configured to hang the laundry thereon are provided in the accommodating space 12. The supporters 16 may be provided to keep the laundry motionlessly still or fixed. Such the supporter may be configured to apply a predetermined movement to the laundry, when supplying air, heated air, water, mist or steam to the laundry, which will be described later. As follows, this configuration will be described in reference to FIGS. 2 and 3.

Figure 2:
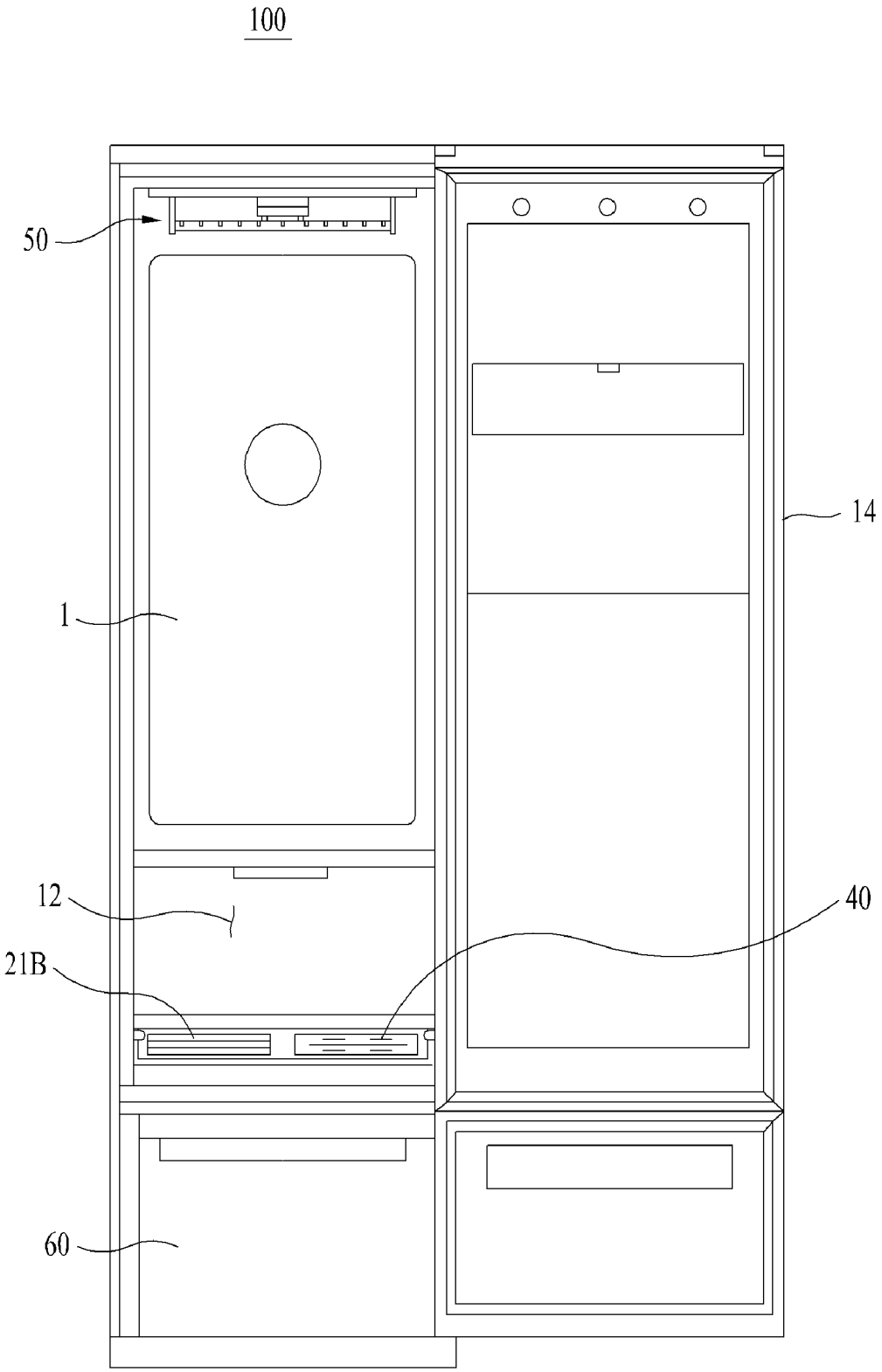
FIG. 2 is a front view illustrating a laundry treatment apparatus according to another embodiment of the present invention.

FIG. 2 is a front view illustrating a laundry treatment apparatus according to another embodiment of the present invention. Compared with the embodiment described above in reference to FIG. 1, the laundry treatment apparatus according to this embodiment includes a moving hanger configured to apply a predetermined movement to laundry, with laundry hung thereon. This difference will be described.

In reference to FIG. 2, the laundry is hung on a moving hanger 50 provided in the accommodating space 12. The moving hanger 50 may apply a predetermined movement to the laundry. When supplying air, heated air, water, mist or steam to the laundry, the predetermined movement is applied to the laundry and then a laundry refreshing effect may be improved.

Figure 3:
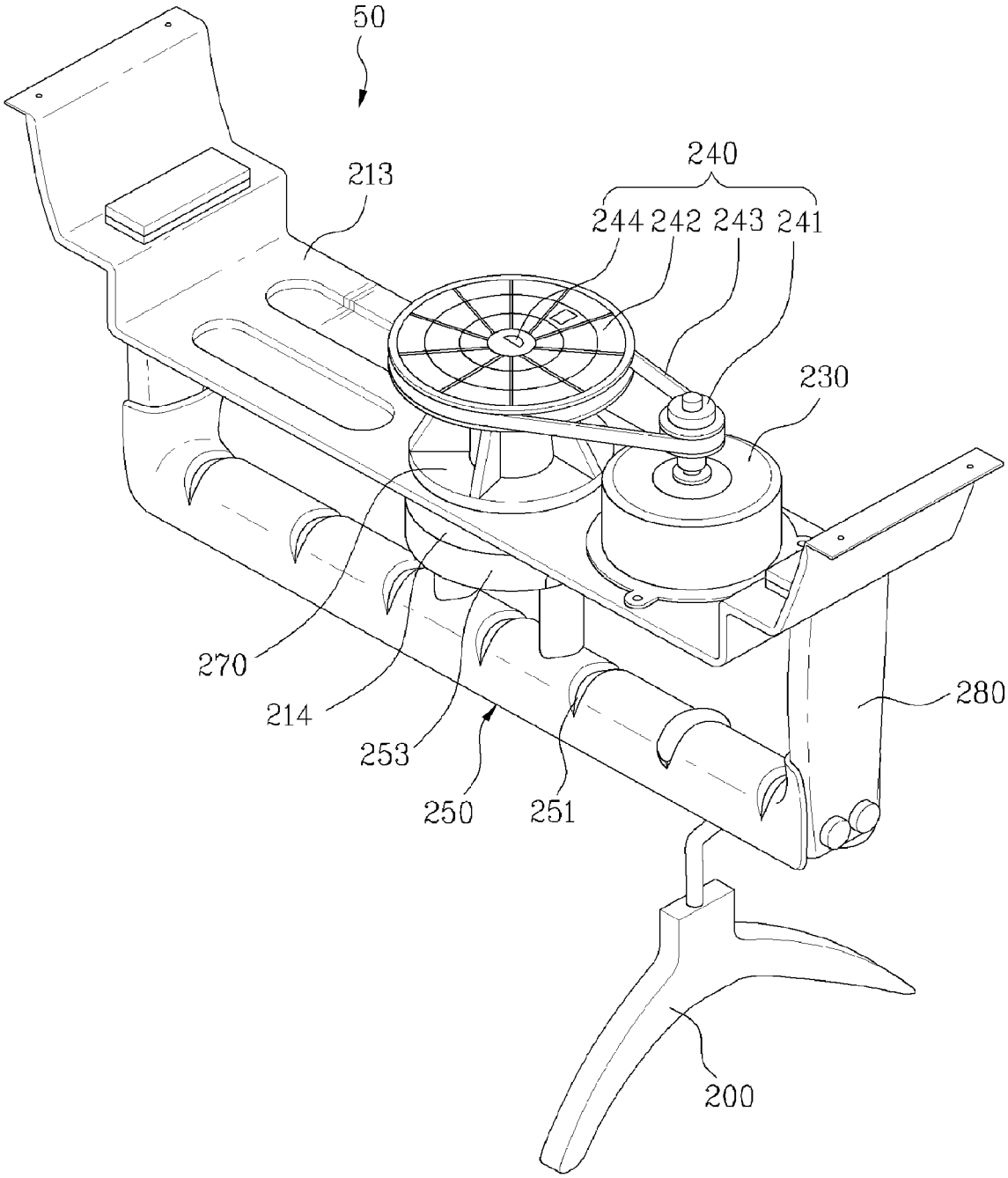
FIG. 3 is a perspective view illustrating a moving hanger of FIG. 2.
Figure 4:
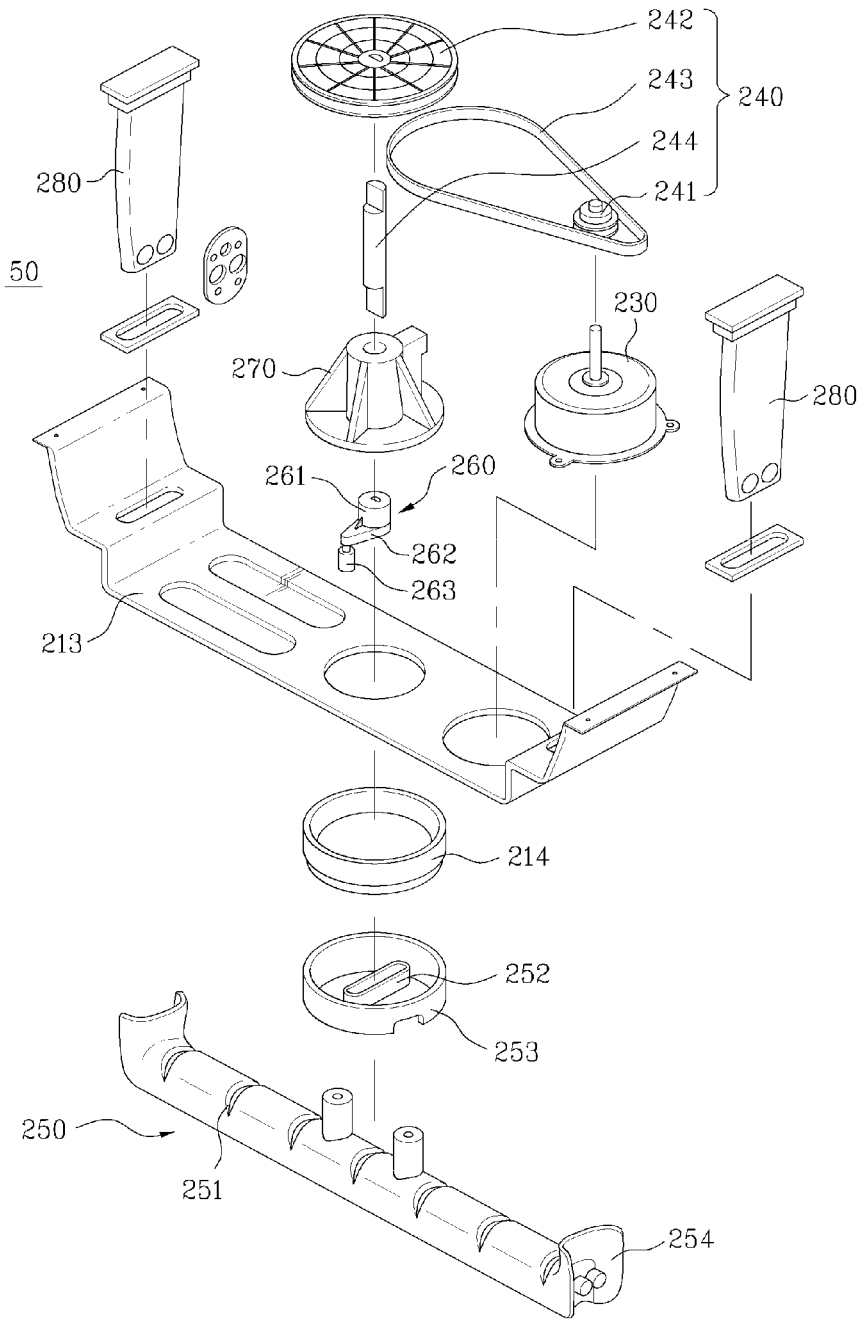
FIG. 4 is an exploded perspective view of FIG. 3.

FIG. 3 is a perspective view illustrating a configuration of the moving hanger 50 and FIG. 4 is an exploded perspective view illustrating the moving hanger 50.

In reference to FIGS. 3 and 4, the moving hanger 50 includes a hanger bar 250 configured to support laundry hung on a hanger 200 and a supporting part 280 configured to support both ends of the hanger bar 250. A plurality of hanger recesses 251 may be provided in the banger bar 250 to fix the location of the hanger 200 hung on the hanger bar 250. The supporting part 280 is connected to a moving hanger frame 213 and the moving hanger frame 213 is provided beyond a ceiling of the cabinet 10, not to be seen outside. Both ends of the hanger bar 250 include supporting part ribs 254, respectively, and the supporting rib 254 is covering the end of the supporting part 280.

As a result, the clothes received in the laundry treatment apparatus according to the present invention are hung on at least one hanger. Because of that, not only an improved refreshing effect but also improved drying efficiency for the clothes may be expected, compared with the conventional laundry treatment apparatus.

In the meanwhile, the moving hanger 50 includes a motor 230, a power converting part 260 configured to convert a rotational force provided by the motor 230 into a horizontally linear motion of the hanger bar 250, and a power transmitting part 240 configured to transmit the power generated from the motor 230 to the power transmitting part 260.

The power transmitting part 240 includes a driving pulley 241 provided in the motor 230, a driven pulley 242 connected to the driving pulley 241 by a belt 243, and a shaft 244 coupled to a center of the driving pulley 242. The shaft 244 may be rotatably provided in a bearing housing 270 provided in the moving hanger frame 213.

The hanger bar 250 may further include a slot 252 which lies at right angles to its longitudinal direction. Specifically, a slot housing 253 is provided on the hanger bar 250 and the slot 252 is located approximately in a center of the slot housing 252. The power converting part 260 may include a slot inserting portion 263 inserted in the slot 252, a shaft connecting portion 261 connected to the shaft 244 and a rotation arm 262 connecting the slot inserting portion 263 and the shaft connecting portion 261 with each other. The power converting part 260 is covered by a cover 214 not to be seen outside and the cover 214 is provided between the moving hanger frame 213 and the slot housing 253.

Under this configuration, when the motor 230 is rotated, the driving pulley 242 is rotated and the shaft 244 coupled to the driving pulley 242 is rotated. At this time, the slot inserting portion 263 will perform a circular motion, with a predetermined diameter.

Here, the slot 252 provided in the hanger bar 250 may be orthogonal to the longitudinal direction of the hanger bar 250. By extension, the length of the slot 252 is larger than a rotational locus of the slot connecting portion 263. Because of that, the slot 252 may perform a linear motion along a horizontal direction even when the slot inserting portion 263 performs a circular motion.

In the meanwhile, a mechanism chamber 20 configured to accommodate the air supplying device 22 and the moisture generating device 30 may be provided in the cabinet 10. The mechanism chamber 20 may be located below the accommodating space 12 and it includes the air supplying device 22 and the moisture generating device 30 received therein. The reason why the mechanism chamber 20 is located below the accommodating space 12 is that the heated air or steam supplied to the accommodating space 12 has a property of ascending and that the mechanism chamber 20 is located below the accommodating space 12 to supply the heated air or steam upwardly.

Figure 5:
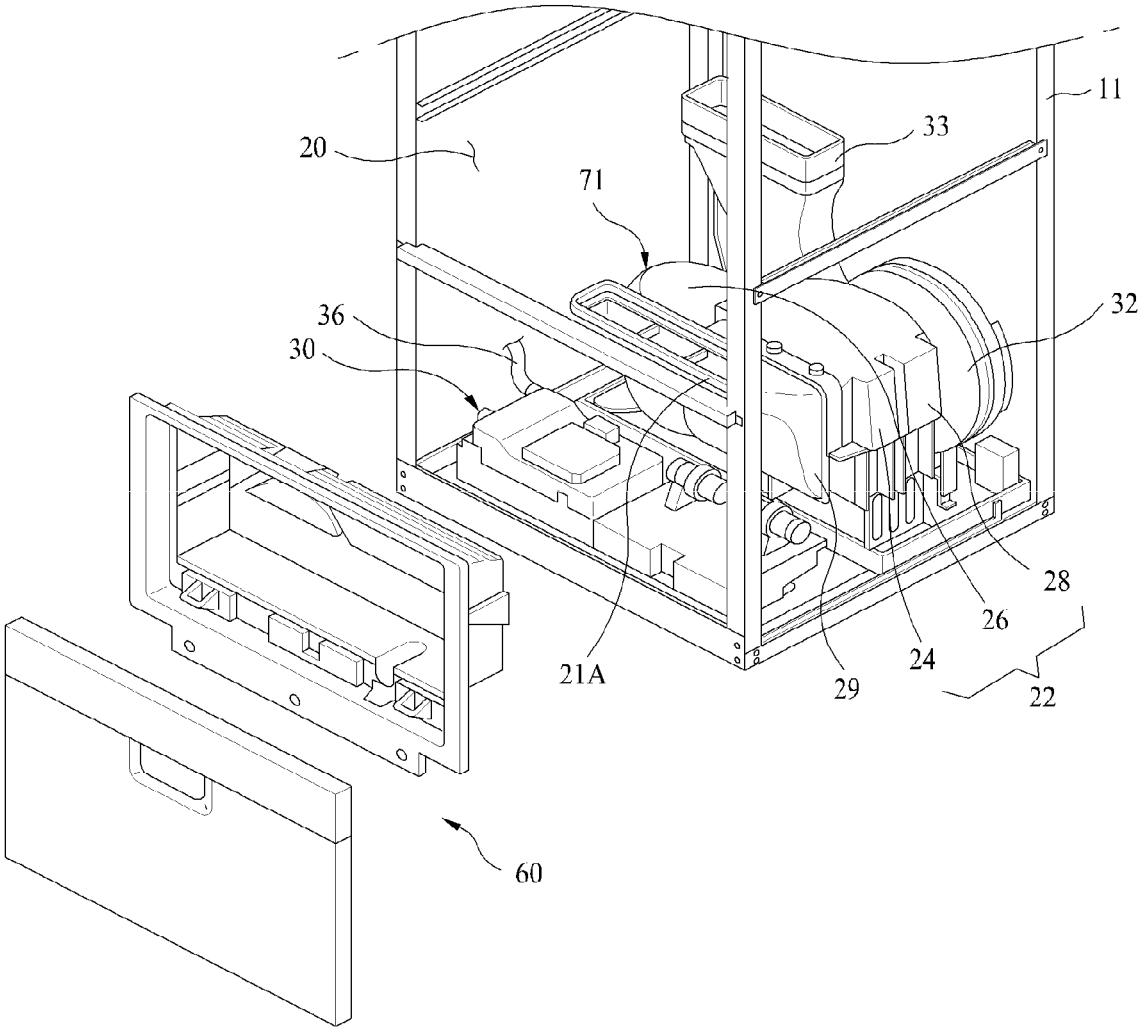
FIG. 5 is a diagram schematically illustrating an inner configuration of a mechanism chamber.

FIG. 5 is a perspective view schematically illustrating an inner configuration of the mechanism chamber 20. To illustrate the inner configuration of the mechanism chamber 20, only a frame 11 of the cabinet 10 is shown in FIG. 5 for convenience sake. In addition, only main components including the air supplying device 22 and the moisture generating device 30 are illustrated in FIG. 5 for convenience sake and a drainage line connecting those components with each other is not illustrated. In reference to FIG. 5, the air supplying device 22 configured to supply air or heated air to the accommodating space 12 may be located within the mechanism chamber 20.

A heat pump 22 embodied as the air supplying device according to the present invention may include an evaporator 24, a compressor 26, a condenser 28 and an expansion valve (not shown) which allow refrigerant to flow there through. Because of that, air is dehumidified and heated.

In other words, latent heat of ambient air is absorbed, while refrigerant is evaporated in the evaporator 24. After that, air is cooled and moisture contained in the air is condensed and eliminated. When refrigerant is condensed in the condenser 28 after passing the compressor 26, latent heat is exhausted toward ambient air. After that, the ambient air may be heated. As a result, the evaporator and the condenser 28 are functioned as heat exchanger. The air sucked into the mechanism chamber 20 may be dehumidified and heated while passing the evaporator 24 and the condenser 28, to be supplied to the accommodating space 12.

The air heated by the heat pump 22 has a relatively lower temperature than the air heated by a conventional electric heater. However, the air heated by the heat pump 22 may be dehumidified without using any auxiliary dehumidifying device. As a result, the air re-supplied to the accommodating space 12 by the heat pump 22 may be corresponding to 'relatively low dry air' (here, the term of 'low temperature' means not an absolutely low temperature but a relatively lower temperature than the temperature of conventional heated air). The laundry treatment apparatus according to the embodiment of the present invention may supply low temperature dry air to the laundry. Because of that, the laundry treatment apparatus according to the embodiment of the present invention may prevent deformity or damage which might be generated by the high temperature of heated air used in performing refreshing or drying for the laundry. That is, the air supplied by the heat pump 22 in the laundry treatment apparatus according to the embodiment of the present invention may have the lower temperature than the hot air supplied in the conventional laundry treatment apparatus but it may be dehumidified without any auxiliary dehumidifying device, to dry and refresh the laundry efficiently and smoothly.

Specifically, an air inlet (21A, see FIG. 5) is formed in a front portion of a top of the mechanism chamber 20 suck air of the accommodating space 12 into the mechanism chamber 20. An air path of the air may be formed by an inlet duct 29 configured to connect the air inlet 21A, the evaporator 24, the condenser 28 and the fan 32 with each other. The air drawn into the mechanism chamber 20 via the air inlet 21A by the inlet duct 29 may be dehumidified and heated while passing the heat pump 22. The dehumidified and heated air may be re-supplied to the accommodating space 12 via an outlet duct 33 and an air outlet 21B by a fan 32.

Here, although not shown in the drawings, a filter may be provided in the air inlet 21A. The filter provided in the air inlet 21A may filter various foreign substances contained in the air drawn into the mechanism chamber 20 from the accommodating space 12 and only fresh air can be re-supplied to the accommodating space 12.

Furthermore, the moisture generating device 30 may be provided in the mechanism chamber 20 to supply water, mist or steam (hereinafter, referenced to as 'steam') to the accommodating space 12 selectively.

The moisture generating device 30 includes a heater (not shown) configured to heat water and the water is heated to generate steam. The moisture generating device 30 supplies the generated steam to the accommodating space 12. An external water tap may be used as water supply source supplying water to the moisture generating device 30 or a water supplying tank (not shown) may be provided in a predetermined portion of the mechanism chamber 20 as water supply source.

The water supplying tank may be provided in a door module 60 detachably installed in a predetermined portion of the mechanism chamber 20. Because of that, a user may separate the water supplying tank from the mechanism chamber 20 for water refill and he or she may re-install the tank.

Also, the steam generated in the moisture generating device 30 is supplied to the accommodating space 12 via a steam hose 36 and a steam nozzle (40, see FIGS. 1 and 2). In this case, it is more preferable, as the shorter the steam hose 36 is, to prevent the temperature of the steam from being lowered or condensed while the steam moving through the steam hose 36. When the mechanism chamber 20 is located below the accommodating space 12, the steam nozzle 40 may supply steam via a top of the mechanism chamber 20 which is a bottom of the accommodating space 12.

A circulating fan (not shown) may be provided in a rear portion of the mechanism chamber 20 and the circulating fan supplies external air to the mechanism chamber 20. Because of that, the internal air of the mechanism chamber 20 may be prevented from increasing too much when the heat pump 22 and the moisture generating device 30 are put into operation.

As follows, a control method of the laundry treating apparatus having the above configuration will be described. The control method which will be described is corresponding to a step of drying laundry by supplying air or heated air to the laundry.

Such a drying step may be set as an auxiliary course, for example, drying course or included in the other courses. When drying the laundry, a humidity sensor is utilized to determine whether laundry drying is completed. That is, the humidity of air having passed the laundry is measured by the humidity sensor and it is determined whether the laundry drying is complete.

However, it is found according to experiments performed by the present inventor that the amount of relative humidity is variable according to the amount of laundry accommodated in the accommodating space, even if the amount of water contained in total laundry (hereinafter, 'contained-water amount') is constant. In other words, as the laundry amount is increasing, the relative humidity is getting heightened, even with the constant contained-water amount. As the laundry amount is decreasing, the relative humidity is getting lowered. As the laundry amount is increasing, a contact area between the laundry and air may be broad. Because of that, the water contained in the laundry is likely to disperse into air. As a result, when determining whether the laundry drying is complete based on the relative humidity of air, a target relative humidity is uniformly set according to a selected course and then laundry drying is performed. In this case, there may be severe deviation in the actually remaining amount of water contained in each of the laundry even after the target relative humidity is reached. Because of that, it is required to remove deviation of the amount of water remaining after the drying is completed, regardless of the laundry amount.

Figure 6:
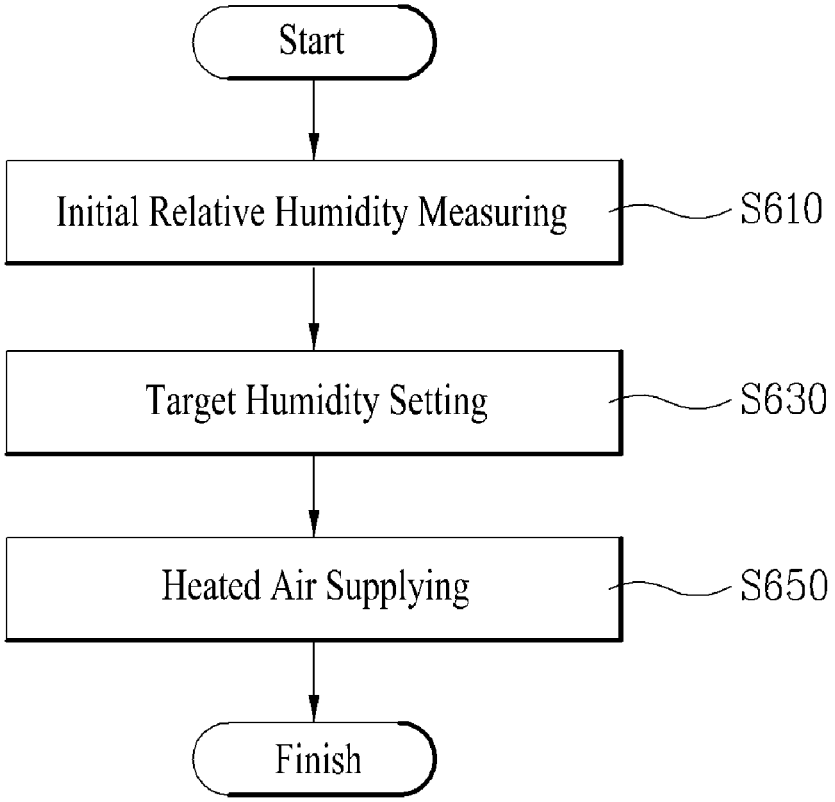
FIG. 6 is a flow chart illustrating a control method according to an exemplary embodiment of the present invention.

FIG. 6 is a flow chart illustrating a control method according to an embodiment of the present invention.

In reference to FIG. 6, a control method according to this embodiment includes a humidity measuring step (S610) of measuring a relative humidity of the accommodating space accommodating laundry therein, a target humidity determining step (S630) of determining a target relative humidity configured to dry the laundry based on the relative humidity measured in the humidity measuring step, and a heated air supplying step (S650) of supplying heated air to the accommodating space based on the target relative humidity. First of all, a user may select one of at least one course including the drying step, which is provided in the laundry treatment apparatus.

Hence, the control part of the laundry treatment apparatus measures a relative humidity of the accommodating space accommodating laundry therein (S610). This step is configured to measure the relative humidity of the accommodating space accommodating the laundry, before supplying heated air to the laundry or in an initial stage of the heated air supplying, and to determine a target relative humidity based on the measured relative humidity. As described above, if the target relative humidity is set uniformly according to the courses, there might be severe deviation of the amount of water contained in the laundry after completing the drying according to the laundry amount. Because of that, the control method according to this embodiment measures the relative humidity of the space accommodating the laundry therein in the initial stage of the drying step, not setting the target relative humidity according to the courses uniformly. After that, the control method sets the target relative humidity based on the measured relative humidity. In setting the target relative humidity, the control method according to this embodiment uses the relative humidity measured in the initial stage of the drying. As a result, even after completing the drying, deviation of the amount of contained water may be reduced even after completing the drying.

When measuring the relative humidity, the relative humidity is measured by using the humidity sensor provided in the laundry treatment apparatus. The humidity sensor may detect the humidity of air having passed the laundry and it may be provided adjacent to an air inlet 21A. When measuring the relative humidity by using the humidity sensor and simultaneously supplying the heated air to the laundry, values measured by the humidity sensor are not precise.

Simultaneously supplying the heated air, the humidity sensor is put into operation to measure the relative humidity. Because of that, the humidity sensor is not stabilized yet. The control method according to this embodiment includes a humidity stabilizing step of stabilizing the humidity sensor for a predetermined time period after supplying the heated air to the laundry. For example, the stabilizing step may include a step of supplying heated air for 3 to 5 minutes. After that, the control part controls the humidity sensor to measure the relative humidity. When measuring the relative sensor, the control part measures the relative humidity by using the humidity sensor for a predetermined time period and it determines an average of the measured values as measured humidity.

After measuring the relative humidity, the control part sets the target relative humidity (S630). The control part determines the target relative humidity based on the measured relative humidity and it sets the target relative humidity according to the selected course.

Specifically, the control part determines a value having a predetermined difference (A) out of the measured relative humidity values. For example, when the relative humidity measured in the initial stage of the drying is 60%, a target relative humidity is set as value remaining after subtracting 'A' from 60%.

In the meanwhile, the predetermined value (A) may be adjusted properly based on the selected course. For example, in case of requiring strong drying, 'A' may be set to be a relatively large value. In an ironing course, the user is expected to iron the laundry after the drying and then 'A' may be set to be a relatively small value. In a standard drying course, 'A' may be set to be larger than in the ironing course.

After the setting the target relative humidity, the control part controls the air supply device 22 to supply heated air to the accommodating space. The control part controls the humidity sensor to detect the relative humidity of air continuously or periodically, simultaneously supplying the heated air. The control part determines that the drying is completed when the relative humidity measured by the humidity sensor reaches a target relative humidity and it controls the operation of the air supply device to finish, such that the drying step is completed.

However, when the heated air is supplied according to the target relative humidity set based on the relative humidity measured in the initial stage of the drying, drying for the laundry happens to be performed too much (over-drying) or drying is finished in a state of the laundry being dried not sufficiently. For example, when the relative humidity measured in the initial stage of the drying is too high, the target relative humidity may be set relatively high and the drying may be finished with the laundry dried not sufficiently. In contrast, when the relative humidity measured in the initial stage is relatively low, the target relative humidity may be set too low and the over-drying may be performed for the laundry. Such the over-drying and insufficient-drying may be generated even if the target relative humidity is variable by several elements, for example, a peripheral temperature/internal temperature of the laundry treatment apparatus, a relative humidity of air and the amount/quality of laundry.

As a result, a control method configured to prevent the over-drying and insufficient-drying will be described according to an embodiment.

Figure 7:
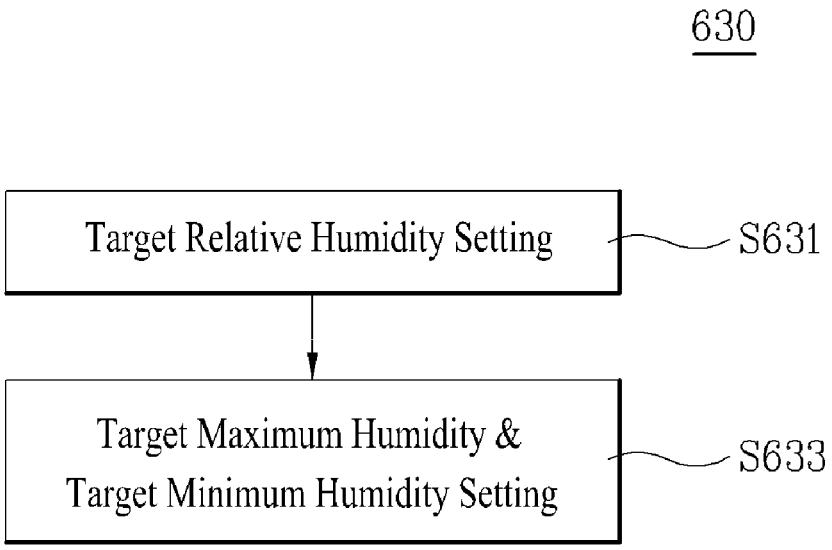
FIG. 7 is a flow chart illustrating a target humidity determining step of FIG. 6 according to another embodiment.
Figure 8:
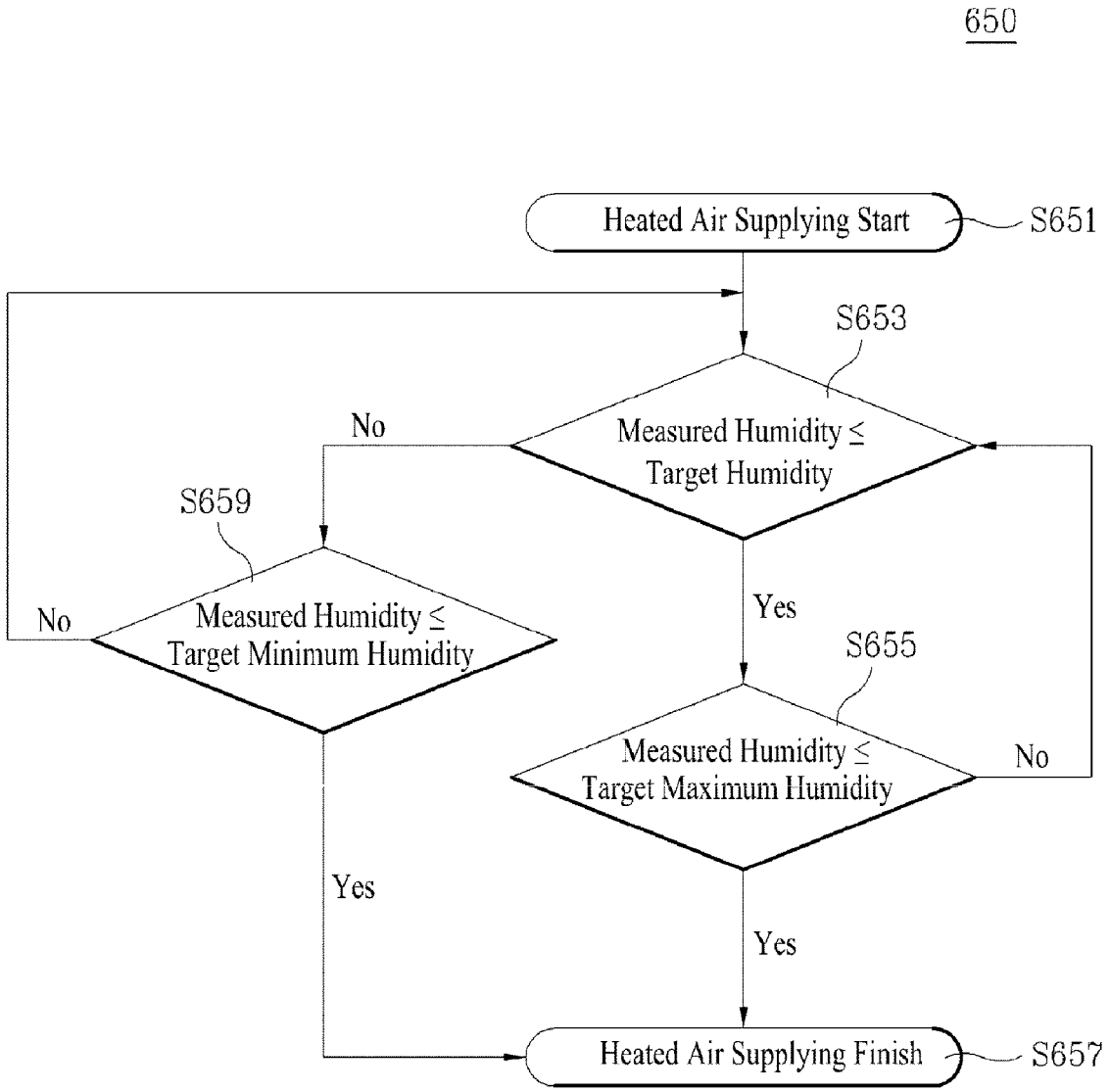
FIG. 8 is a flow chart specifically illustrating a heated air supplying step according to the embodiment of FIG. 7.

FIGS. 7 and 8 are flow charts illustrating a control method according to an embodiment to prevent the over-drying and insufficient-drying.

In reference to FIG. 7, a target humidity setting step (630) of the control method according to this embodiment further includes a target relative humidity determining step (S631) and a target maximum humidity and/or a target minimum humidity determining step (S633). The target maximum humidity is configured to prevent the insufficient drying and the target minimum humidity is to prevent the over-drying.

The target maximum humidity and the target minimum humidity may be set properly according to the selected course, regardless of the relative humidity measured in the initial stage of the drying. For example, the target maximum humidity may be set to be getting lower in the order of the ironing course, the standard drying course and the strong drying course. The target minimum humidity may be set to be getting lower in the same order of the standard drying course and the strong drying course. Here, the target maximum humidity may be set to be the target minimum humidity or lower in a single course.

FIG. 8 is a flow chart illustrating a heated air supplying step of supplying heated air to the accommodating space according to this embodiment.

In reference to FIG. 8, the control part starts the heated air supplying (S651) and it compares the measured relative humidity with the target humidity continuously or periodically (S653). In this case, when the measured humidity is the target relative humidity or lower, the control part re-compares the measured humidity with the target maximum humidity, without finishing the heated air supplying step (S655). As mentioned above, if the relative humidity measured in the initial stage of the drying is relatively high to set the target relative humidity to be relatively high, the drying might be finished with the laundry having the water too much. The above step may prevent this insufficient drying. As a result, the control part supplies the heated air continuously until the measured relative humidity is lowered to reach the target maximum humidity or lower, even in case it reaches the target relative humidity or lower. The control part finishes the heated air supplying when the measured relative humidity is the target relative humidity or lower, by extension, the target maximum humidity or lower (S657).

In the meanwhile, the control part compares the measured relative humidity with the target minimum humidity when the measured relative humidity is the target relative humidity or higher (S659). In case the relative humidity measured initially is relatively low to set the target relative humidity to be too low, the relative humidity reaches the target minimum humidity set according to the courses before reaching the target relative humidity. In this case, the control part finishes the heated air supplying step to prevent the over-drying for the laundry. When the measured relative humidity is the target minimum humidity or lower even in case the measured relative humidity fails to reach the target relative humidity, the control part determines that the drying is completed and it finishes the heated air supplying to complete the heated air supplying step (S657).

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention has an industrial applicability.

The control method including the above steps may detect the relative humidity in the initial stage of the drying, when setting the target relative humidity used to determine the completion of drying, and it may set the target relative humidity based on the measured relative humidity. As a result, it is possible to remove deviation of the amount of water remaining in the laundry after completing the drying, regardless of the laundry amount.

The invention claimed is:

1. A control method of a laundry treatment apparatus comprising:

a course selecting step of selecting at least one course of the laundry treatment apparatus, the at least one course including a drying step;

a humidity measuring step of measuring a relative humidity of an accommodating space accommodating laundry;

a target humidity setting step of setting a target relative humidity based on the relative humidity measured in the humidity measuring step, to dry the laundry; and a heated air supplying step of supplying heated air to the accommodating space based on the target relative humidity, wherein the target humidity setting step sets the target relative humidity according to the selected course.

2. The control method of the laundry treatment apparatus as claimed in claim 1, wherein the target relative humidity of the target humidity setting step is set to be a value having a predetermined difference from the measured relative humidity.

3. The control method of the laundry treatment apparatus as claimed in claim 2, wherein the predetermined difference is variable according to the selected course.

4. The control method of the laundry treatment apparatus as claimed in claim 1, wherein the target humidity setting step comprises, a target maximum humidity and a target minimum humidity setting step of setting a target maximum humidity and a target minimum humidity.

5. The control method of the laundry treatment apparatus as claimed in claim 4, wherein the target maximum humidity and the target minimum humidity are variable according to the selected course.

6. The control method of the laundry treatment apparatus as claimed in claim 5, wherein the target maximum humidity and the target minimum humidity are preset according to the selected course.

7. The control method of the laundry treatment apparatus as claimed in claim 5, wherein the target maximum humidity and the target minimum humidity are preset, regardless of the measured relative humidity.

8. The control method of the laundry treatment apparatus as claimed in claim 5, wherein the heated air supplying step supplies heated air based on at least one of the target relative humidity, the target maximum humidity and the target minimum humidity.

9. The control method of the laundry treatment apparatus as claimed in claim 8, wherein the heated air supplying step finishes when the target maximum humidity is reached.

10. The control method of the laundry treatment apparatus as claimed in claim 8, wherein the heated air supplying step is finished when the target minimum humidity is reached, in case the target relative humidity is not reached.

11. The control method of the laundry treatment apparatus as claimed in claim 1, further comprising:

a stabilizing step of stabilizing a sensor configured to measure a relative humidity, the stabilizing step performed before the humidity measuring step.

12. The control method of the laundry treatment apparatus as claimed in claim 11, wherein the stabilizing step is supplying heated air for a predetermined time.

13. The control method of the laundry treatment apparatus as claimed in claim 1, wherein the humidity measuring step measures the relative humidity for a predetermined time period, to determine an average of measured values as measured humidity.

14. A control method of a laundry treatment comprising:

a course selecting step of selecting at least one course of the laundry treatment apparatus, the at least one course including a drying step;

a target relative humidity setting step of setting a target relative humidity based on the selected course, to dry laundry;

target maximum humidity and a target minimum humidity setting step of setting a target maximum humidity and a target minimum humidity according to the selected course; and a heated air supplying step of supplying heated air based on at least one of the target relative humidity, the target maximum humidity and the target minimum humidity, wherein the target relative humidity is set by at least one of a peripheral temperature, humidity, the amount of laundry and a quality of the laundry, and wherein the heated air supplying step is finished when the target minimum humidity is reached, in case the target relative humidity is not reached, wherein the heated air supplying step is finished when the target minimum humidity is reached, in case the target relative humidity is not reached.

15. The control method of the laundry treatment apparatus as claimed in claim 14, wherein the target maximum humidity and the target minimum humidity are preset, regardless of the measured relative humidity.

16. The control method of the laundry treatment apparatus as claimed in claim 14, wherein the heated air supplying step finishes when the target maximum humidity is reached.

* * * * *